US005322112A

United States Patent [19]

Sakata

[11] Patent Number: 5,322,112

[45] Date of Patent: Jun. 21, 1994

[54] CASTING-THICKNESS VARIABLE MOLD FOR CONTINUOUS CASTING

[75] Inventor: Yutaka Sakata, Niihama, Japan

[73] Assignee: Sumitomo Heavy Industries, Ltd., Tokyo, Japan

[21] Appl. No.: 20,402

[22] Filed: Feb. 22, 1993

[30] Foreign Application Priority Data

Mar. 4, 1992 [JP] Japan ..... 4-082672

[51] Int. Cl.[5] ..... B22D 11/04

[52] U.S. Cl. ..... 164/436; 164/491

[58] Field of Search ..... 164/491, 436

[56] References Cited

U.S. PATENT DOCUMENTS 4,510,990 4/1985 Artz et al. ..... 164/436

FOREIGN PATENT DOCUMENTS 57-62840 4/1982 Japan ..... 164/436

2-35386 9/1990 Japan .

*Primary Examiner*—Kuang Y. Lin

*Attorney, Agent, or Firm*—Nikaido Marmelstein Murray & Oram

[57] ABSTRACT

A casting-thickness variable mold enabling the thickness of a casting to be quickly and easily changed in an on-line condition. The mold includes a stationary long-side frame, a movable long-side frame, and two sets of short-side frames provided at either end of a space between the long-side frames. Each set comprises a main short-side frame having a large width-determining dimension, and an auxiliary short-side frame having a small width-determining dimension. The main short-side frame is disposed on the side of the space contacting the stationary long-side frame, and is connected to a main short-side frame moving device comprising a short-side moving spindle and a spindle driver. The auxiliary short-side frame is disposed on the side of the space contacting the movable long-side frame, and is connected to an auxiliary short side frame moving device comprising a short-side moving rod and a rod-driving hydraulic cylinder.

2 Claims, 3 Drawing Sheets

CASTING-THICKNESS VARIABLE MOLD FOR CONTINUOUS CASTING

BACKGROUND OF THE INVENTION

1. Field of the Invention

The present invention relates to a casting-thickness variable mold for continuous casting. More particularly, the present invention relates to a casting-thickness variable mold of the above kind which is able to form a mold cavity having a desired casting thickness by changing the dimension of short-side frames disposed between a pair of long-side frames that determines the width of the mold cavity (that is, the dimension corresponding to the thickness of a casting; hereinafter referred to as "the width-determining dimension").

2. Description of Related Art

In a conventional continuous casting system, when it is necessary to change the thickness of a casting, the currently used mold is replaced with a mold constructed to provide the desired thickness, and such replacement is performed each time a change in the casting thickness is needed (Related Art Example I). However, changing the mold size in this manner takes a long time. In addition, various types of molds, each being able to provide a fixed thickness, have to be prepared beforehand, thus incurring a high equipment cost.

In view of these problems, an apparatus has been proposed as a casting-thickness variable mold which allows short-side frames to be quickly replaced in an on-line condition of the apparatus (Japanese Utility Model Examined Publication No. 2-35386; Related Art Example II). FIG. 3 shows the basic construction of such a casting-thickness variable mold. The mold includes a pair of long-side frames, one of which is a stationary frame 1. The other long-side frame is a movable frame 2, which is disposed opposite the stationary frame. Short-side frames 51 and 52, having a certain width-determining dimension corresponding to a desired casting thickness, are disposed in a space between the long-side frames 1 and 2 in such a manner that the frames 51 and 52 can be replaced. Each short-side frame 51 or 52 is connected with a spindle 5 of a short-side moving device which is used in an operation for changing the casting thickness.

In Related Art Example II, when the casting thickness is to be changed, the short-side frames 51 and 52 currently used are disconnected from the spindles 5, and other short-side frames capable of providing a desired size are mounted.

With the mold of Related Art Example II, although operational efficiency is improved as compared with Related Art I, changing the casting thickness can still be troublesome because, each time such an operation is required, the spindles 5 must be disconnected from and re-connected to the short-side frames 51 and 52, and a water supply pipe, etc. (not shown) have to be disconnected and re-connected to the associated components. Another problem is that, although the spindles 5 can be connected to the substantially central positions of short-side frames 51 and 52 when these frames have a small width-determining dimension, the spindles 5 are inevitably connected to positions offsetting from the center in the case of short-side frames having a large width-determining dimension. In the latter case, when the short-side frames are being moved in the casting-thickness changing operation, these frames may be subjected to torsion, thereby damaging long-side copper plates 6.

SUMMARY OF THE INVENTION

The present invention has been made in view of the above-described circumstances. An object of the present invention is to provide a casting-thickness variable mold which enables the thickness of a casting to be quickly and easily changed in an on-line condition, and which prevents the movement of short-side frames from involving torsion, and hence, prevents damage to long-side copper plates.

According to the present invention, there is provided a casting-thickness variable mold for continuous casting, comprising: a stationary long-side frame, a movable long-side frame, and two sets of short-side frames provided at either end of a space between the long-side frames, wherein each of the sets of the short-side frames comprise at least two short-side frames having different dimensions for determining the width of a mold cavity, each of the short-side frames is connected with a short-side moving device for moving the short-side frame in the width direction of a casting, and the movable long-side frame has a notch space formed therein, the notch space being capable of receiving one of the short-side frames after the short-side frame has started to retract so that the movable long-side frame is prevented from interfering with such a retracted short-side frame.

Each of the sets of the short-side frames may comprises a main short-side frame having a large width-determining dimension, and an auxiliary short-side frame having a small width-determining dimension. The main short-side frame is disposed on the side of the space contacting the stationary long-side frame, and is connected to a main short-side frame moving device comprising a short-side moving spindle and a driver for driving the spindle. The auxiliary short-side frame is disposed on the side of the space contacting the movable long-side frame, and is connected to an auxiliary short-side frame moving device comprising a short-side moving rod and an actuator for driving the rod.

According to the present invention, a plurality of short-side frames are independently connected to moving devices. Therefore, when some of the short-side frames are independently advanced or retracted in a space between a pair of long-side frames, it is possible to change the casting thickness easily without the need to dismount and mount short-side frames. For instance, when only the main short-side frame, among a set of short-side frames comprising the main short-side frame and an auxiliary short-side frame, is advanced in the space between the long-side frames, the mold provides a relatively small thickness of a casting. When the auxiliary short-side frame, as well as the main short-side frame, is advanced in the space between the long-side frames, the mold provides a relatively large casting-thickness. In such casting-thickness changing operations, the auxiliary short-side frame can be advanced or retracted by a moving rod and a driving actuator which are independently provided for use with the auxiliary short-side frame. Therefore, the operation of changing the casting thickness can be performed very quickly and easily.

During retraction of the auxiliary short-side frame, it is received in a notch space. Therefore, when the mold is to form a mold cavity with a dimension corresponding to a small casting-thickness, there is no risk of interference occurring between the auxiliary short-side frame and the movable long-side frame.

DESCRIPTION OF THE PREFERRED EMBODIMENTS

Embodiments of the present invention will now be described with reference to the drawings.

Figure 1:
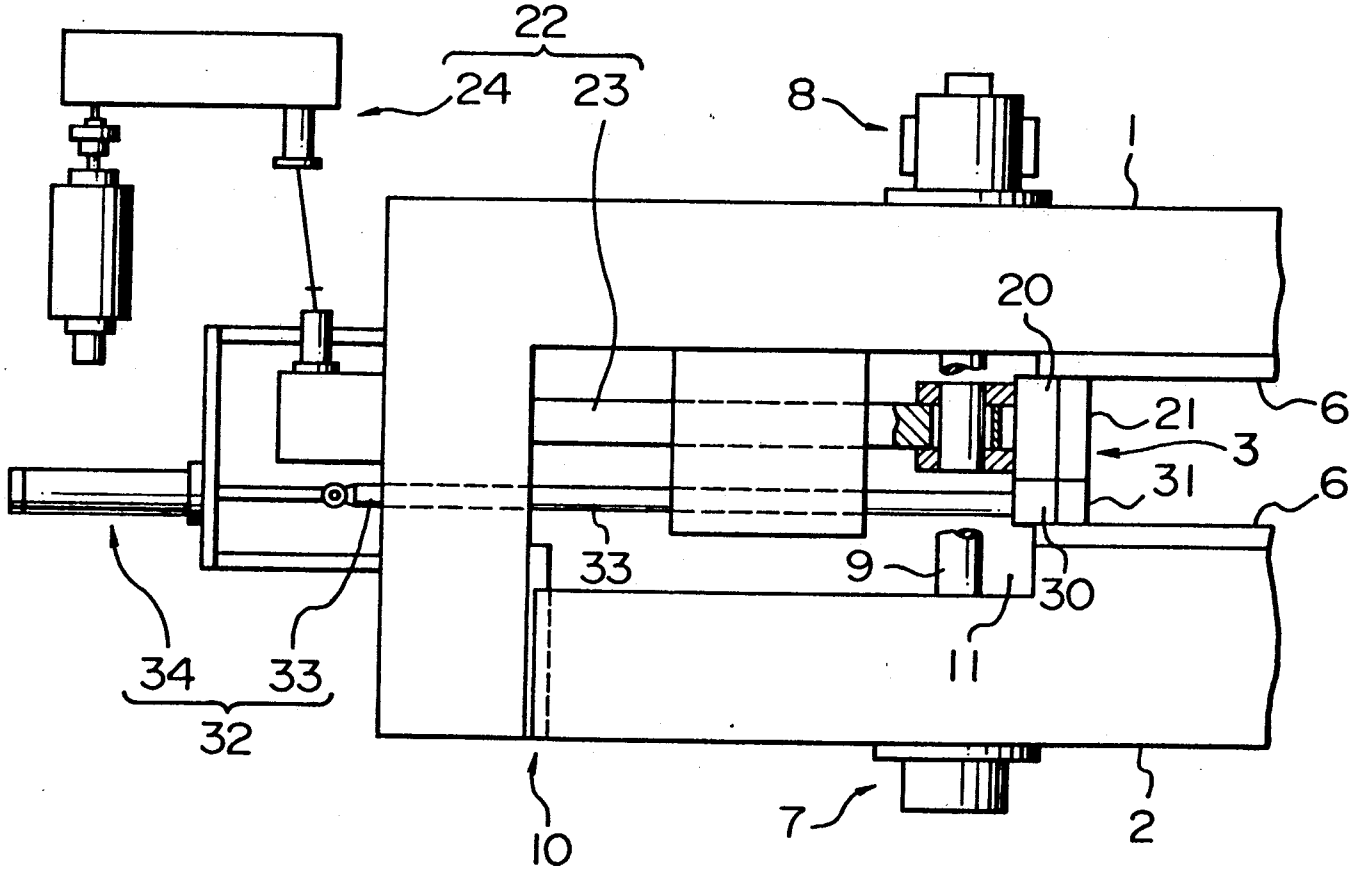
FIG. 1 is a fragmentary plan view of a casting-thickness variable mold according to an embodiment of the present invention, showing one end portion of the mold
Figure 2:
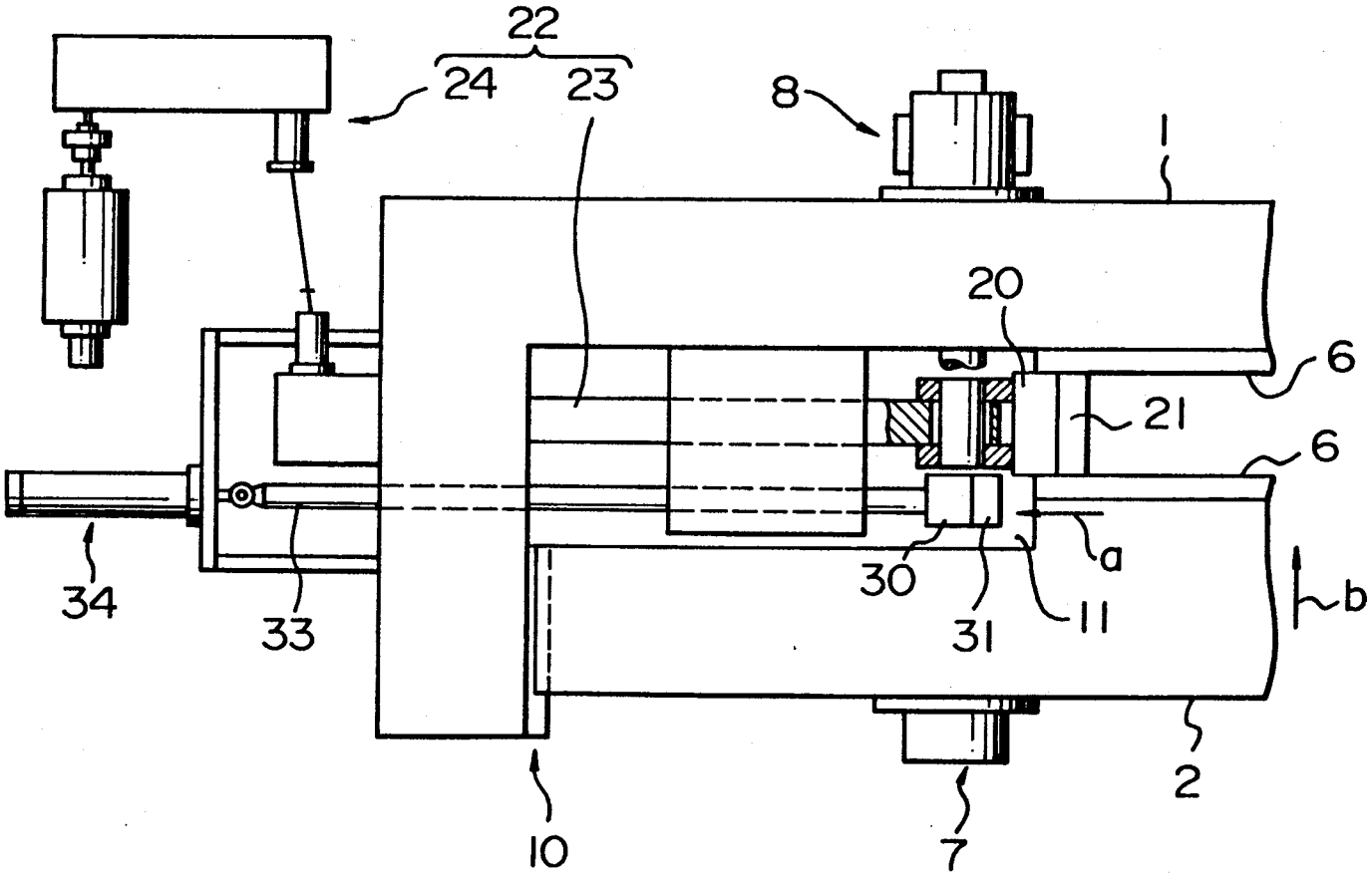
FIG. 2 is a fragmentary plan view of the casting-thickness variable mold shown in FIG. 1, showing a state of the mold in which a small casting-thickness is set.
Figure 3:
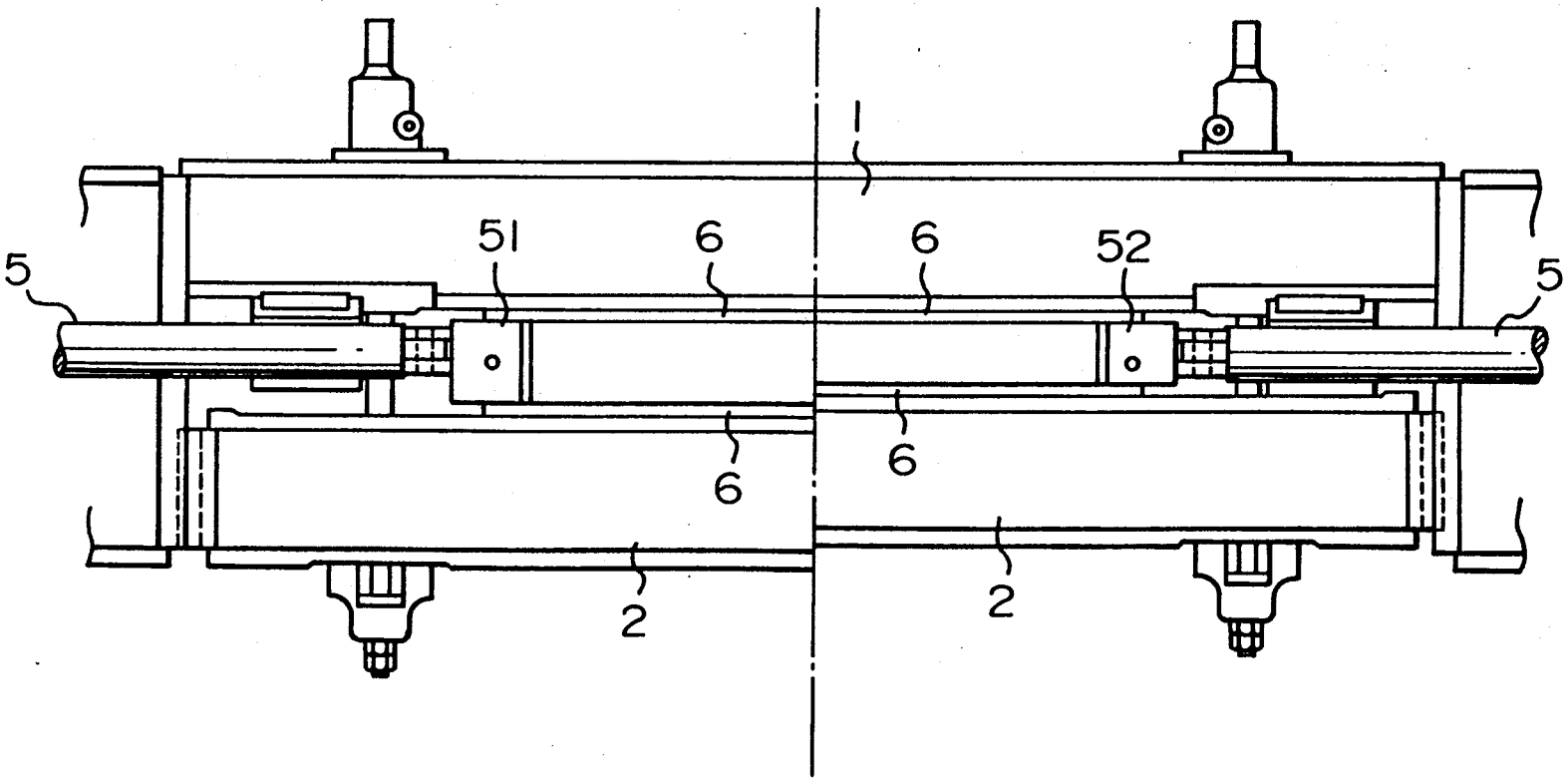
FIG. 3 PRIOR ART
FIG. 3 is a plan view schematically showing a conventional variable-thickness mold.

FIG. 1 shows, in a fragmentary plan view, an end portion of a casting-thickness variable mold according to an embodiment of the present invention, the mold being in a state where a large casting-thickness is set. FIG. 2 is another fragmentary plan view of the mold shown in FIG. 1, which shows a state where a small casting-thickness is set.

Referring to FIG. 1, the mold includes a stationary long-side frame 1 and a movable long-side frame 2 having a known construction. That is, the long-side frames 1 and 2 each have a long-side copper plate 6, and are linked to each other by a tie rod 9. In addition, a clamping device 7 and a worm jack 8 are provided so that the movable long-side frame 2 can be moved toward the stationary long-side frame 1. More specifically, the movable long-side frame 2 can slide toward the stationary long-side frame 1 by being guided by a slide guide 10 provided between the two long-side frames 1 and 2.

The mold further includes two sets 3 of short-side frames (only one set is shown in the drawings). Each set 3 comprises a main short-side frame 20 and an auxiliary short-side frame 30. A short-side copper plate 21 or 31 is mounted to each short-side frame 20 or 30.

The main short-side frame 20 is connected to a spindle 23 of a main short-side moving device 22. The spindle 23 can be advanced and retracted in its axial direction by a driver 24 of the device 22. The main short-side moving device 22 has a construction similar to that of a short-side moving device in a conventional thickness-variable mold.

The auxiliary short-side frame 30 is connected to a rod 33 of an auxiliary short-side moving device 32. The rod 33 is connected to a hydraulic cylinder 34 of the device 32, the hydraulic cylinder 34 serving as an actuator for driving the rod 33. Reciprocation in the hydraulic cylinder 34 enables the auxiliary short-side frame 30 to advance to a mold-cavity forming position between the long-side frames 1 and 2, and retract to a non-mold-cavity forming position A notch space 11 is formed in each end portion of the movable long-side frame 2. When the auxiliary short-side frame 30 has started to retract, the movable long-side frame 2 does not interfere with the frame 30 but receives it in the notch space 11.

FIG. 1 shows a state in which the casting thickness is set to a large dimension. In this state, the auxiliary short-side frame 30 is advanced to a position beside the advanced position of the main short-side frame 20, and these short-side frames 20 and 30 cooperates with each other to constitute an advanced short-side frame unit. The illustrated state can be achieved by a casting-thickness changing operation in which the spindle 23 of the main short-side moving device 22 and the rod 33 of the auxiliary short-side moving device 32 are operated in synchronization.

FIG. 2 shows a state in which the casting thickness is set to a small dimension. In order to achieve this state from the state shown in FIG. 1, the auxiliary short-side frame 30, having a small width-determining dimension, is moved in the direction indicated by arrow a to a retracted position by operating the hydraulic cylinder 34, so that only the main short-side frame 20 will determine the width of a mold cavity. The movable long-side frame 2 is slid in the direction indicated by arrow b by driving the worm jack 8, so that the main short-side frame 20 is held between the stationary long-side frame 1 and the movable long-side frame 2 which has been slid. During the above operation, since the auxiliary short-side frame 30 becomes received in the notch space 11 formed in the movable long-side frame 2, the auxiliary short-side frame 30 is prevented from interfering with the movable long-side frame 2.

Such an operation of changing the casting thickness from the large dimension to the small dimension, or vice versa, can be performed by advancing or retracting the auxiliary short-side frame 30 by using the hydraulic cylinder 34, and sliding the movable long-side frame 2. Accordingly, the casting-thickness changing operation is very simple, and can be quickly performed in an on-line condition. Furthermore, the spindle 23 for moving the main short-side frame 20 and the rod 33 for moving the auxiliary short-side frame 30 are connected to the associated frames at substantially central locations thereof. Therefore, when the short-side frame 20 or 30 is being moved in a thickness changing operation, there is no risk of torsion, hence, damage to the long-side copper plate 6.

Other embodiments of the present invention will be described.

Although in the foregoing embodiment, each set of short-side frames includes one auxiliary short-side frame 30, two or more auxiliary short-side frames may be included. In this case, the thickness of a casting can be quickly changed in three or more stages. Further, although in the foregoing embodiment, a hydraulic cylinder 34 is used as an actuator for driving the auxiliary short-side frame 30, this arrangement may be substituted by an arrangement including a screw rod capable of being rotated by an electric or a hydraulic motor, and a spindle meshing with the screw rod and capable of reciprocating. Thus, any desired means may be adopted as the moving devices. It is possible, for instance, that the driving device 22 for the main short-side frame 21 include a spindle connected through a clutch mechanism.

According to the present invention, the casting thickness provided by the mold can be quickly changed in an on-line condition. Furthermore, since a central location of a short-side frame is pushed or pulled in a casting-thickness changing operation, it is possible to prevent torsion, and hence, prevent damage to the long-side copper plate.

What is claimed is:

1. A casting-thickness variable mold for continuous casting, comprising, a stationary long-side frame, a movable long-side frame, and two sets of short-side frames provided at either end of a space between said long-side frames, wherein each of said sets of said short-side frames comprise at least two short-side frames having different dimensions for determining the width of a mold cavity, each of said short-side frames is connected with a short-side moving device for moving the short-side frame in the width direction of a casting, and said movable long-side frame has a notch space formed therein, said notch space being capable of receiving one of said short-side frames after the short-side frame has started to retract so that said movable long-side frame is prevented from interfering with such a retracted short-side frame.

2. A casting-thickness variable mold for continuous casting, according to claim 1, wherein each of said sets of said short-side frames comprises a main short-side frame having a large width-determining dimension, and an auxiliary short-side frame having a small width-determining dimension, said main short-side frame being disposed on the side of said space contacting said stationary long-side frame, and being connected to a main short-side frame moving device comprising a short-side moving spindle and a driver for driving said spindle, said auxiliary short-side frame being disposed on the side of said space contacting said movable long-side frame, and being connected to an auxiliary short-side frame moving device comprising a short-side moving rod and an actuator for driving said rod.

* * * * *